United States Patent [19]

O'Hara

[11] 4,021,035

[45] May 3, 1977

[54] KNEE BALL EXERCISE GAME APPARATUS

[75] Inventor: Patrick L. O'Hara, San Francisco, Calif.

[73] Assignee: Fee International, Ltd., Oklahoma City, Okla.

[22] Filed: Aug. 1, 1975

[21] Appl. No.: 601,185

[52] U.S. Cl. ..... 272/78; 273/DIG. 19

[51] Int. Cl.[2] ..... A63B 69/00

[58] Field of Search ..... 272/78, 80, 57 R, 57, 272/94, 139, 93; 273/58 C, 98, DIG. 19, DIG. 17; 46/51

[56] References Cited

UNITED STATES PATENTS

| | | | |
|---|---|---|---|
| 885,927 | 4/1908 | Hulsmann | 272/78 |
| 2,097,376 | 10/1937 | Marshman | 272/80 |

FOREIGN PATENTS OR APPLICATIONS

| | | | |
|---|---|---|---|
| 728,643 | 7/1932 | France | 272/78 |

*Primary Examiner*—Richard C. Pinkham
*Assistant Examiner*—William R. Browne
*Attorney, Agent, or Firm*—Laney, Dougherty, Hessin & Fish

[57] ABSTRACT

A game apparatus for primary use in exercising which consists of an adjustable waist belt having a plurality of circumferentially disposed hooks for receiving adjustable attachment of a tethered cord supporting a light, resilient ball or similar round object with an inflatable bladder. The tether cord is adjustable as to length in order to be compatible with each user. The hooks on the belt are disposed along the length of the belt.

1 Claim, 2 Drawing Figures

KNEE BALL EXERCISE GAME APPARATUS

BACKGROUND OF THE INVENTION

1. Field of the Invention

The invention relates generally to game apparatus and, more particularly, but not by way of limitation, it relates to an improved ball game apparatus having primary application as an exercising device.

2. Description of the Prior Art

The prior art includes a great many types of ball apparatus or game as utilized in tether during intended operation and in some cases games have been devised where a plurality of tethered balls are utilized. To Applicant's knowledge, the most pertinent prior art would be the U.S. Pat. No. 2,186,016 in the name of J. R. Evans entitled "Exercising Ball and Support Therefor" which includes a manual gripping stick, tether cord and ball, which device is utilized as an exercise apparatus relating to foot kicking of the ball in some time sequence or coordination, much on the order of skipping rope. A prior art belt-type of device is shown in the U.S. Pat. No. 3,751,031 in the name of Yamauchi as entitled "Weighted Belt Type Exercising Device". This prior art teaches the use of a belt in an exercising device; however, the similarity ends there as the intention is to support large and increasing weight from the belt of the user.

SUMMARY OF THE INVENTION

The present invention contemplates a tethered ball exercising device wherein a tethered, resilient ball is adjustably supported from a belt which the user wears about the waist. Thereafter, the user exercises to achieve weight loss and/or muscle tone through coordinated exercises as between knees and head or other body combinations in keeping the ball in rhythmic motion.

Therefore, it is an object of the present invention to provide an improved exercising device requiring skill of use thereby tending to sharpen coordinate muscle skills while providing the requisite body exercise.

It is also an object of the invention to provide a tethered ball apparatus wherein the skills of competitive users may be tested.

Finally, it is an object of the present invention to provide a body supported game apparatus which requires skill of use and provides both exercise and game involvement to the user or users.

Other objects and advantages of the invention will be evident from the following detailed description when read in conjunction with the accompanying drawing which illustrates the invention.

DETAILED DESCRIPTION OF THE PREFERRED EMBODIMENT

Figure 1:
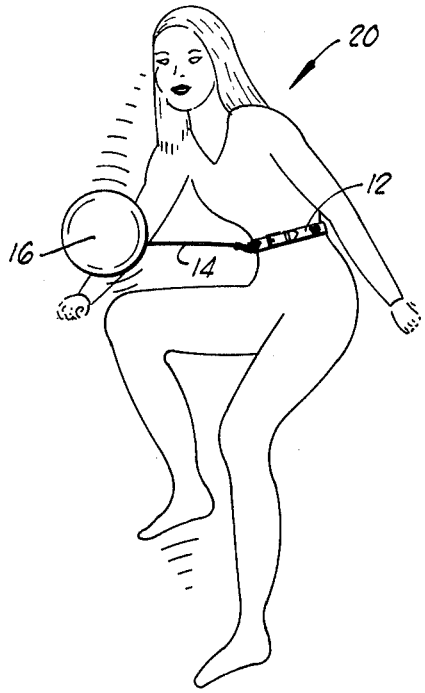
FIG. 1 is a representation of a subject utilizing the invention in one form of application.
Figure 2:
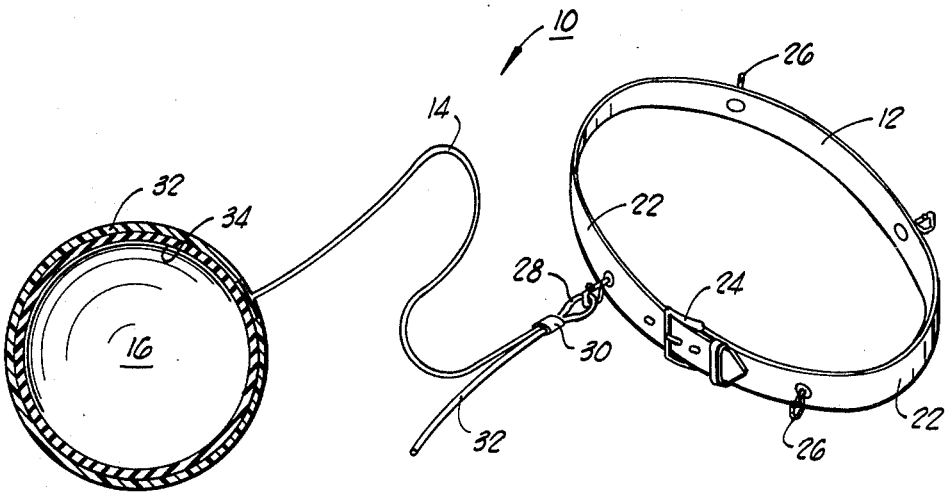
FIG. 2 is a perspective view of the game apparatus with portions shown in section.

Referring to FIGS. 1 and 2 of the drawing, a game apparatus 10 consists of a belt 12 as adjustably affixed to a tether cord 14 which, in turn, is affixed to a resilient ball 16. The depiction of FIG. 1 illustrates one form of use wherein a subject 20 is shown with the game apparatus 10 in function with belt 12 waistattached, operation of which will be further discussed below.

Referring again to FIG. 2, the belt 12 consists of a conventional form of leather belt 22 which is adjustably affixable about the waist of a subject user by means of a buckle 24. A plurality of snap hooks 26 are suitably secured on leather belt 22 along the length thereof to enable the subject user to affix the tether cord 14 at selected locations about the body. The snap hooks 26 may be a conventional form of spring-loaded hook which is affixed as by rivet measures through the leather belt 22.

The tether cord 14 consists of a suitable form of light cord material which is flexible and can be formed into a loop 28 by means of a suitable form of slide fastener 30. The tether cord 14 should be long enough to enable use by all persons tall or short, and the length of cord 14 can be adjusted by moving slide fastener 30, and utilizing bitter end 32, to adjust the position of loop 28 for each subject user. Slide fastener 30 can be any conventional form of releasable clamping device, or it may simply be a friction or compression sleeve device which is movable on cord 14 by application of sufficient force.

The outer end of tether cord 14 is then suitably affixed for retention in the ball 16. Ball 16 is depicted as being such as a ball having a leather or soft material outer cover 32 as inflated by a rubber bladder 34. In this case, the outer end of the tether cord 14 may be affixed as by stitching or other similar affixing means to the outer cover 32 without puncturing or need for connection to inner rubber bladder 34. It should be understood, however, that the ball 16 may take any of many forms ranging from unitary rubber ball to what is termed the Nerf-type of ball and affixure of tether cord 14 may be carried out by various conventional and known means.

In operation, the subject 20 merely attaches the belt 12 about the waist and thereafter adjusts the length of tether cord 14 in accordance with the subject's height an particular exercise operation, i.e., desired usage, adjustment being effected by movement of clamping sleeve 30. As shown in FIG. 1, the subject 20 is using game apparatus 10 by setting up a rhythmic counter-bounce of ball 16 between her right knee and forehead. The subject 20 may effect such counter-bounce at whatever the required speed in order to achieve good rhythmic coordination and effective striking of ball 16, the object being to maintain counter-bounce of ball 16 as shown for an extended period of time.

The subject 20 can also then perform the same ball counter-bounce as between her left knee and forehead, feet and head, and snap loops 26 can be varied about the circumference of the waist to enable still other forms of bodily rhythmic counter-bouncing of ball 16. It may be that plural subject users will utilize game apparatus 10 for competitive game use, e.g., comparison of skills to determine which subject can maintain the longest ball counter-bounce or use of the most difficult body parts in effecting counter-bounce.

The foregoing discloses a novel combination making up a game and exercising apparatus which serves not only to provide body exercise an develop tonal coordination, but which can also be used individually competitive or skills applications. While specific forms and designs of material are illustrated a making up the preferred embodiment, it should be understood that many forms of individual components can be utilized in making up the combination. Further, it is contemplated that flexible cord 14 which, while in the preferred embodiment is not elongatable, may take the form of a flexible and elongatable or longitudinally elastic cord, thereby to provide still greater degree of difficulty in properly manipulating or using the game apparatus 10.

Changes may be made in the combination and arrangement of elements as heretofore set forth in the specification and shown in the drawing; it being understood that changes may be made in the embodiment disclosed without departing from the spirit and scope of the invention as defined in the following claims.

What is claimed is:

1. A game apparatus which is attachable to the subject user's body to provide exercise and skill usage, comprising in combination:

a single belt disposed only around the subject user's waist and including means for releasably fastening the belt around a user's waist said belt further including a plurality of snap hooks affixed in generally equi-spaced disposition along the entire length for the belt only one tether cord having a loop means at one end for securement to a selected one of said snap hooks;

adjustable clamping means movably secured on said tethered cord to provide adjustment of said loop thereby altering the length of the tethered cord in accordance with the subject user's desire;

a sphere constructed of resilient material which is secured to the remaining force end of said tethered cord; and inflatable rubber bladder means disposed within said sphere.

* * * * *